US007573005B2

(12) United States Patent
Clothier

(10) Patent No.: US 7,573,005 B2
(45) Date of Patent: Aug. 11, 2009

(54) BOIL DETECTION METHOD AND COMPUTER PROGRAM

(75) Inventor: Brian L. Clothier, Wichita, KS (US)

(73) Assignee: Thermal Solutions, Inc., Wichita, KS (US)

( * ) Notice: Subject to any disclaimer, the term of this patent is extended or adjusted under 35 U.S.C. 154(b) by 584 days.

(21) Appl. No.: 11/083,432

(22) Filed: Mar. 18, 2005

(65) Prior Publication Data

US 2005/0247696 A1 Nov. 10, 2005

Related U.S. Application Data

(60) Provisional application No. 60/564,111, filed on Apr. 22, 2004.

(51) Int. Cl.
*H05B 1/02* (2006.01)

(52) U.S. Cl. ..... 219/497; 219/501; 219/505; 219/412; 374/102

(58) Field of Classification Search ..... 219/497, 219/499, 494, 412–415, 501, 505, 492; 374/102, 374/120, 121
See application file for complete search history.

(56) References Cited

U.S. PATENT DOCUMENTS

| | | | |
|---|---|---|---|
| 1,975,436 | A | 10/1934 | Sorrel et al. |
| 1,975,437 | A | 10/1934 | Sorrel |
| 1,975,438 | A | 10/1934 | Sorrel |
| 2,988,623 | A | 6/1961 | Ross et al. |
| 3,153,132 | A | 10/1964 | Greene |
| 3,612,803 | A | 10/1971 | Klaas |
| 3,734,077 | A | 5/1973 | Murdough et al. |
| 3,742,174 | A | 6/1973 | Harnden, Jr. |
| 3,742,178 | A | 6/1973 | Harnden, Jr. |
| 3,742,179 | A | 6/1973 | Harnden, Jr. |
| 3,745,290 | A | 7/1973 | Harnden, Jr. et al. |
| 3,761,668 | A | 9/1973 | Harnden, Jr. et al. |
| 3,777,094 | A | 12/1973 | Peters, Jr. |

(Continued)

FOREIGN PATENT DOCUMENTS

| | | |
|---|---|---|
| CH | 294154 | 1/1954 |

(Continued)

OTHER PUBLICATIONS

U.S. Appl. No. 60/044,074, filed Jun. 15, 1996, Ablah et al.

(Continued)

*Primary Examiner*—Mark H Paschall
(74) *Attorney, Agent, or Firm*—Hovey Williams LLP

(57) ABSTRACT

A method, computer program, and cooking device for detecting boiling of liquids. The invention is implemented with a computer program executed by a processor or other computing device of a cooking unit such as an induction range. The computer program comprises a code segment for receiving an indication of successive temperatures of the vessel and for calculating a slope of a curve representing the successive temperatures versus time; a code segment for detecting boiling of the liquid based on the slope of the curve; and a code segment for providing an output which may be used to indicate the boiling. The computer program may also include a code segment for receiving variables relating to parameters and/or characteristics of the cooking vessel to refine the boiling detection.

9 Claims, 4 Drawing Sheets

U.S. PATENT DOCUMENTS 3,786,220 A 1/1974 Harnden, Jr.
3,806,688 A 4/1974 MacKenzie et al.
3,828,164 A 8/1974 Fisher et al.
3,843,857 A 10/1974 Cunningham
3,916,872 A 11/1975 Kreis et al.
3,978,307 A 8/1976 Amagami et al.
3,979,572 A 9/1976 Ito et al.
3,989,916 A 11/1976 Amagami et al.
4,013,859 A 3/1977 Peters, Jr.
4,016,392 A 4/1977 Kobayashi et al.
4,020,310 A 4/1977 Souder, Jr. et al.
4,032,740 A 6/1977 Mittelmann
4,035,606 A 7/1977 Browder
4,110,587 A 8/1978 Souder, Jr. et al.
4,115,676 A 9/1978 Higuchi et al.
4,235,282 A 11/1980 de Filippis et al.
4,246,884 A 1/1981 Vandas
4,256,945 A 3/1981 Carter et al.
4,266,108 A 5/1981 Anderson et al.
4,319,109 A 3/1982 Bowles
4,381,438 A 4/1983 Goessler et al.
4,454,403 A 6/1984 Teich et al.
4,456,807 A 6/1984 Ogino et al.
4,493,981 A * 1/1985 Payne ..... 219/448.12
4,527,031 A 7/1985 Aparicio
4,533,807 A 8/1985 Minamida
4,542,271 A 9/1985 Tanonis et al.
4,544,818 A 10/1985 Minamida
4,555,608 A 11/1985 Mizukawa
4,556,770 A 12/1985 Tazima et al.
4,560,849 A 12/1985 Migliori et al.
4,567,877 A 2/1986 Sepahpur
4,568,810 A 2/1986 Carmean
4,572,864 A 2/1986 Benson et al.
4,587,406 A 5/1986 Andre
4,614,852 A 9/1986 Matsushita et al.
4,617,442 A 10/1986 Okuda
4,625,098 A 11/1986 Joe
4,638,135 A 1/1987 Aoki
4,646,935 A 3/1987 Ulam
4,764,652 A 8/1988 Lee
4,774,395 A 9/1988 Yabuuchi et al.
4,776,386 A 10/1988 Meier
4,795,886 A 1/1989 Carter, Jr.
4,810,847 A 3/1989 Ito
4,816,633 A 3/1989 Mucha et al.
4,816,646 A 3/1989 Solomon et al.
4,820,891 A 4/1989 Tanaka et al.
4,864,088 A 9/1989 Hiejima et al.
4,914,267 A 4/1990 Derbyshire
4,916,290 A 4/1990 Hawkins
4,982,722 A 1/1991 Wyatt
4,983,798 A 1/1991 Eckler et al.
4,987,828 A 1/1991 Nuns et al.
4,996,405 A 2/1991 Poumey et al.
RE33,644 E 7/1991 Hall
5,052,369 A 10/1991 Johnson
5,078,050 A 1/1992 Smith
5,079,398 A 1/1992 Kuiemka
5,125,391 A 6/1992 Srivastava et al.
5,129,314 A 7/1992 Hu
5,132,918 A * 7/1992 Funk ..... 700/270
5,134,266 A 7/1992 Dickens et al.
5,177,333 A 1/1993 Ogasawara
5,180,075 A 1/1993 Montalbano
5,194,708 A 3/1993 Carter, Jr.
5,202,150 A 4/1993 Benson et al.
5,227,597 A 7/1993 Dickens et al.
5,254,380 A 10/1993 Salyer
5,300,105 A 4/1994 Owens
5,300,757 A * 4/1994 Hara et al. ..... 219/497
5,357,693 A 10/1994 Owens
5,379,042 A 1/1995 Henoch
5,401,939 A 3/1995 Iguchi et al.
5,408,073 A 4/1995 Jeong
5,424,514 A 6/1995 Lee
5,424,519 A 6/1995 Salee
5,466,915 A 11/1995 Meier et al.
5,487,329 A 1/1996 Fissler
5,493,103 A 2/1996 Kuhn
5,499,017 A 3/1996 Beigel
5,518,560 A 5/1996 Li
5,530,702 A 6/1996 Palmer et al.
5,545,198 A 8/1996 Owens
5,545,877 A * 8/1996 Shelton ..... 219/497
5,603,858 A 2/1997 Wyatt et al.
5,611,328 A 3/1997 McDermott
5,643,485 A 7/1997 Potter et al.
5,648,008 A 7/1997 Barritt et al.
5,682,143 A 10/1997 Brady
5,700,284 A 12/1997 Owens
5,705,794 A 1/1998 Gillespie
5,750,962 A 5/1998 Hyatt
5,874,902 A 2/1999 Heinrich et al.
5,880,435 A 3/1999 Bostic
5,885,635 A 3/1999 Carville
5,892,202 A 4/1999 Badwin et al.
5,928,551 A 7/1999 Okabayashi
5,932,129 A 8/1999 Hyatt
5,951,900 A 9/1999 Smrke
5,954,984 A 9/1999 Ablah et al.
5,963,134 A 10/1999 Bowers et al.
5,963,144 A 10/1999 Kruest
5,968,398 A 10/1999 Schmitt et al.
5,999,700 A 12/1999 Geers
6,018,143 A 1/2000 Check
6,025,780 A 2/2000 Bowers et al.
6,046,442 A 4/2000 Kawamura et al.
6,060,696 A 5/2000 Bostic
6,072,383 A 6/2000 Gallagher, III et al.
6,097,014 A 8/2000 Kirsch
6,108,489 A 8/2000 Frohlich et al.
6,114,675 A 9/2000 Wada et al.
6,121,585 A 9/2000 Dam
6,150,642 A 11/2000 Weiss
6,201,474 B1 3/2001 Brady et al.
6,232,585 B1 5/2001 Clothier et al.
6,274,856 B1 8/2001 Clothier et al.
6,316,750 B1 11/2001 Levin
6,316,753 B2 * 11/2001 Clothier et al. ..... 219/621
6,320,169 B1 11/2001 Clothier
6,342,830 B1 1/2002 Want et al.
6,350,972 B1 2/2002 Wright et al.
6,353,208 B1 3/2002 Bostic et al.
6,359,268 B1 3/2002 Walter
6,384,387 B1 5/2002 Owens et al.
6,444,961 B2 9/2002 Clothier et al.
6,462,316 B1 * 10/2002 Berkcan et al. ..... 219/502
6,504,135 B2 1/2003 Clothier et al.
6,512,211 B1 1/2003 Lockhart et al.
6,566,634 B2 5/2003 Boyd et al.
6,578,469 B2 6/2003 Sharpe
6,664,520 B2 12/2003 Clothier
2001/0032546 A1 10/2001 Sharpe
2002/0008102 A1 1/2002 Boyd et al.
2003/0001009 A1 1/2003 Collins et al.

FOREIGN PATENT DOCUMENTS

DE 2504827 8/1975
DE 3501304 7/1985
DE 4024432 2/1992
DE 4208249 9/1993
DE 4428353 2/1995

| | | | |
|---|---|---|---|
| DE | 4439095 | | 5/1996 |
| DE | 19648397 | | 11/1997 |
| DE | 19637561 | | 2/1998 |
| DE | 19714701 | | 10/1998 |
| DE | 19729661 | | 1/1999 |
| DE | 19729662 | | 1/1999 |
| DE | 19818831 | | 10/1999 |
| EP | 0354151 | | 2/1990 |
| EP | 0404209 | | 12/1990 |
| EP | 0412875 | | 2/1991 |
| EP | 0427879 | | 5/1991 |
| EP | 0453634 | | 10/1991 |
| EP | 0251333 | | 12/1992 |
| EP | 0346860 | | 1/1995 |
| EP | 0450744 | | 10/1995 |
| EP | 0453634 | | 1/1996 |
| EP | 0412875 | | 4/1996 |
| EP | 0725556 | | 8/1996 |
| EP | 0757509 | | 2/1997 |
| EP | 0921708 | | 6/1999 |
| GB | 2199545 | | 7/1988 |
| GB | 2308947 | | 7/1997 |
| JP | 5425542 | B2 | 2/1979 |
| JP | 6463989 | | 3/1989 |
| JP | 01097412 | | 4/1989 |
| JP | 6489273 | | 4/1989 |
| JP | 6124776 | | 5/1994 |
| JP | 10149875 | A | 6/1998 |
| JP | 2001122342 | | 8/2001 |
| WO | 9524817 | | 9/1995 |
| WO | 9711578 | | 3/1997 |
| WO | 9805184 | | 2/1998 |
| WO | 9941950 | | 8/1999 |
| WO | 9949766 | | 10/1999 |

OTHER PUBLICATIONS

U.S. Appl. No. 60/035,815, filed Jan. 8, 1997, Ablah et al.
U.S. Appl. No. 08/902,803, filed Jul. 30, 1997, Ablah et al.
U.S. Appl. No. 09/314,824, filed May 19, 1999, Ablah et al.
U.S. Appl. No. 08/688,987, filed Jul. 31, 1999, Clothier.
U.S. Appl. No. 10/046,885, filed Jan. 15, 2002, Ablah et al.
Author Unknown. Kitchen Kapers Kitchenware Superstore. www.kitchenkapers.com/vesmirroylav.html.
Author Unknown. Scholtes—the Revolution Induction. www.scholtes.fr/induction/inductions/3_1.html.
Author Unknown. DIAS GmbH—Uncooled Infrared Detectors. www.dias-infrared.de/eng/products/sensors/sen_frm.php.
Author Unknown. Smart Pan RF Smart Cooktop System. Digital Cookware, Inc. www.digitalcookwareinc.com/NU810RF.htm.
Carter Hoffmann Corporation; Patient Meal Make-up and Delivery System Offers You Better Choices.
CookTek, Induction Cooking System; Smartpak Pizza Thermal Delivery System PTDS-100, PTDS-200.
Cooking & Laundry Technology; Automatic Cooktop; Reprinted from AM—Appliance Manufacturer; Feb. 2002.
Flyer for Trade Show: 2002 International Appliance Tech. Conf.; Held Mar. 25-27, 2002.
Metcal, The SmartHeat Company; Metcal SCC Soldering Cartridges.
Metcal, The SmartHeat Company; Metcal Tips and Accessories.
Metcal, The SmartHeat Company; Metcal/STSS Systems.
Seco Products Corporation; Healthcare Mini Catalog.
Seco Products Corporation; System 9-9 Unitized Base.
Seco Products Corporation; System 9-molded Cover for 9" Unitized Base System 7-molded Cover for 7-3/4" Unitized Base.
Seco Products Corporation; Unitized Base Dispensers.
Seco Products Corporation; System 9-Combination Base/China Dispense Base/Tray Dispenser.
S. Zinn and S.L. Semiatin, Elements of Induction Heating Design, Control, and Applications, pp. 157-161 (Battelle Press 1988).
Therma-Systems Corporation; Solutions Made Easy.
Tzeng, Jim J-W., George Getz, Brian S. Fedor, and Dan W. Krassowski. "Anisotropic Graphite Heat Spreaders For Electronics Thermal Management". Graftech, Inc.

* cited by examiner

BOIL DETECTION METHOD AND COMPUTER PROGRAM

RELATED APPLICATIONS

The present application is a non-provisional patent application and claims priority benefit of earlier-filed U.S. provisional patent application entitled BOIL DETECTION SOFTWARE FOR RFID-CONTROLLED SMART INDUCTION RANGE, Ser. No. 60/564,111, filed Apr. 22, 2004. This application is also related to co-pending U.S. application Ser. No. 10/355,989, filed Jan. 31, 2003, and entitled RFID-CONTROLLED SMART INDUCTION RANGE AND METHOD OF COOKING AND HEATING. Both applications are hereby incorporated by reference into the present application.

COMPUTER PROGRAM LISTING APPENDIX

A computer program listing appendix containing the source code of a computer program that may be used with the present invention is incorporated herein by reference and appended hereto as one (1) original compact disc, and an identical copy thereof, containing a total of 46 files as follows:

| Date of Creation | Size (Bytes) | Filename |
|---|---|---|
| Mar. 12, 2005 | 164,652 | /current/HAM.HEX |
| Mar. 10, 2005 | 74,908 | /current/ham_boil.c |
| Mar. 10, 2005 | 18,377 | /current/HAM_COMM.C |
| Mar. 10, 2005 | 6,637 | /current/HAM_CONS.H |
| Mar. 10, 2005 | 942 | /current/HAM_FUNC.H |
| Mar. 10, 2005 | 17,172 | /current/HAM_HARD.C |
| Mar. 10, 2005 | 26,789 | /current/HAM_MAIN.C |
| Mar. 12, 2005 | 99,170 | /current/ham_main.lst |
| Mar. 10, 2005 | 64,000 | /current/HAM_RAM.H |
| Mar. 10, 2005 | 14,288 | /current/ham_rec.c |
| Mar. 10, 2005 | 47,550 | /current/ham_s001.c |
| Mar. 10, 2005 | 5,068 | /current/ham_s001.h |
| Mar. 12, 2005 | 201,605 | /current/ham_S001.lst |
| Mar. 10, 2005 | 8,614 | /current/HAM_STUP.ASM |
| Mar. 10, 2005 | 89,201 | /current/ham_tmp.c |
| Mar. 10, 2005 | 1,177 | /current/ham_tmp.h |
| Mar. 10, 2005 | 23,624 | /current/ham_txrx.c |
| Mar. 12, 2005 | 108,644 | /current/ham_txrx.lst |
| Mar. 10, 2005 | 24,068 | /current/HAM_ZVP.C |
| Mar. 12, 2005 | 2,652 | /current/Level1.bpr |
| Mar. 10, 2005 | 1,140 | /current/Level1.cpp |
| Mar. 10, 2005 | 9,290 | /current/MagicNumber.h |
| Mar. 10, 2005 | 4,741 | /current/MTYPEDEF.H |
| Mar. 10, 2005 | 3,355 | /current/RealTimeUnit.h |
| Mar. 10, 2005 | 6,972 | /current/recipe.h |
| Mar. 10, 2005 | 340 | /current/SETJMP.H |
| Mar. 10, 2005 | 13,051 | /current/SR101C57.H |
| Mar. 10, 2005 | 518 | /current/Unit1.cpp |
| Mar. 10, 2005 | 328 | /current/Unit1.dfm |
| Mar. 10, 2005 | 745 | /current/Unit1.h |
| Mar. 10, 2005 | 726 | /current/Variables.txt |
| Mar. 29, 2004 | 61,254 | /original/Compensate.cpp |
| Oct. 08, 2004 | 61,254 | /original/Compensate.txt |
| Mar. 18, 2004 | 31,547 | /original/RealTimeUnit.cpp |
| Mar. 30, 2004 | 39,911 | /original/RealTimeUnit.dfm |
| Mar. 29, 2004 | 15,305 | /original/RealTimeUnit.h |
| Oct. 08, 2004 | 31,547 | /original/RealTimeUnit.txt |
| Feb. 26, 2004 | 10,814 | /original/Recipe.cpp |
| Oct. 08, 2004 | 10,814 | /original/Recipe.txt |
| Mar. 18, 2004 | 4,301 | /original/RfiqRealTime.bpr |
| Feb. 13, 2004 | 1,314 | /original/RfiqRealTime.cpp |
| Oct. 08, 2004 | 1,314 | /original/RfiqRealTime.txt |
| Feb. 12, 2004 | 5,465 | /original/Rice.rcp |
| Sep. 19, 2003 | 1,536 | /original/RiceRecipe.rcp |
| Mar. 30, 2004 | 119,820 | /original/TempControl.cpp |
| Oct. 08, 2004 | 119,820 | /original/TempControl.txt |

The computer listings on these compact discs are incorporated into the present application by reference.

BACKGROUND OF THE INVENTION

1. Field of the Invention

The present invention relates to cooking devices and methods. More particularly, the invention relates to a method, computer program and cooking device for detecting boiling of a liquid.

2. Description of the Prior Art

Food preparers often desire to detect when liquids such as water or water combined with food items first begin to boil and to then maintain a controlled or "soft boil" for the duration of a cooking period. Such steps are often done manually. For example, a food preparer typically places a pot or other cooking vessel filled with water on a heating element, heats the pot at high power, visually observes the water for signs of boiling, and then manually adjusts the power or heating level of the heating element to maintain a soft boil thereafter. Although such manual boil detection methods are generally effective, they require a great deal of manual supervision and control and are, therefore, inefficient for establishments which prepare large amounts of food, such as restaurants or food processors. Such manual methods also often result in overheating and resultant boiling over of the liquids.

Food thermometers and other temperatures sensors can, of course, be used to monitor the temperature of liquids and detect boiling, but such sensors still require manual supervision and monitoring. Moreover, sensors must be placed in contact with the liquids and therefore must be frequently cleaned. The sensors also often fall into the cooking vessels or are dropped, misplaced, etc.

Systems and methods for automatically monitoring and controlling the temperature of liquids in a cooking vessel have been developed to alleviate some of the above-described problems. For example, U.S. Pat. Nos. 5,951,900; 4,587,406; and 3,742,187 disclose non-contact temperature regulation devices and methods using radio frequency transmissions to communicate temperature information between a cooking vessel and an induction heating appliance.

However, the systems described in these patents have never been developed and are limited in many respects. Ranges and cooking vessels have been developed that use temperature feedback based on temperature information gathered from the vessel to vary power output to the vessel and thereby control its temperature. One such system employs an infrared sensor that is an integral part of a cooking hob. The infrared sensor is mounted on a cylindrical casing designed to direct an infrared sensing beam onto a specific portion of the cooking vessel. The temperature information gathered from the infrared sensor beam is used to alter the power output of the hob. Unfortunately, such a system suffers from a number of limitations, including, for example, an undesirably extreme sensitivity to changes in the emissivity of the region of the vessel on which the infrared sensor beam is directed. If the vessel's surface becomes soiled or coated with oil or grease, the emissivity changes and, as a result, the perceived or sensed temperature is not the actual temperature.

Another such cooking system uses a sensing unit which rests upon the handle of the cooking vessel and directs an infrared sensor beam downward onto the food within the vessel to sense the temperature of the food. The temperature information is then converted into a radio frequency signal that is transmitted to a radio frequency receiving unit within an induction range. This radio frequency temperature information is used to alter the power output of the range to control the temperature of the vessel. Unfortunately, this system also suffers from a number of limitations, including, for example, an excessive sensitivity to the emissivity of the food surfaces within the pan.

Moreover, none of these prior art systems and methods accurately detect boiling of liquids and provide an alert or other indication of the boiling. Accordingly, there is a need for an improved method or system for accurately and quickly detecting when liquids within a cooking vessel begin to boil.

SUMMARY OF THE INVENTION

The present invention solves the above-described problems by providing an improved method, computer program, and cooking device for detecting boiling of liquids.

One embodiment of the invention is implemented with a computer program executed by a processor or other computing device of a cooking unit such as an induction range. The computer program comprises a code segment for receiving an indication of successive temperatures of the vessel and for calculating a slope of a curve representing the successive temperatures versus time; a code segment for detecting boiling of the liquid based on the slope of the curve; and a code segment for providing an output which may be used to indicate the boiling. The computer program may also include a code segment for receiving variables relating to parameters and/or characteristics of the cooking vessel to refine the boiling detection.

Another embodiment of the invention is implemented with a cooking device comprising a heating element for heating the vessel; a data input for receiving data representative of successive temperatures of the vessel over time; and a computing device operable to detect boiling of the liquid based on the data and to provide an output which may be used to announce the boiling of the liquid to a user. The data input may also receive variables relating to parameters and/or characteristics of the cooking vessel for use in detecting the boiling. Another embodiment of the invention is implemented with a method comprising the steps: placing the vessel on a heating element of a cooking unit; measuring successive temperatures of the vessel over time; detecting boiling of the liquid in the vessel based on the successive temperatures over time; and providing an indication that the liquid is boiling.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

Figure 1:
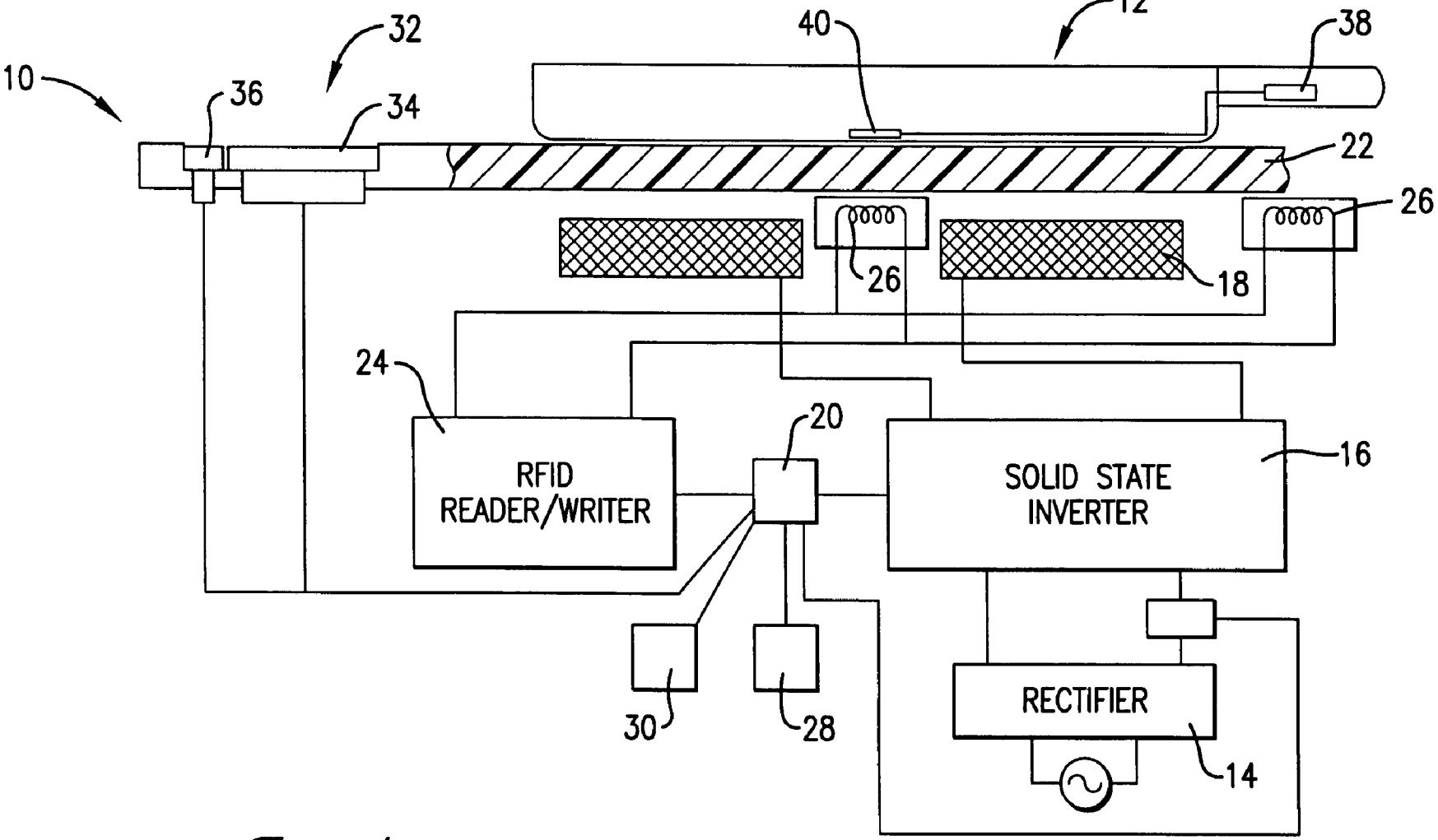
FIG. 1 is a schematic diagram of a cooking vessel placed upon a cooking device which may be used to implement an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENT

The present invention can be implemented in hardware, software, firmware, or a combination thereof. One embodiment of the invention is implemented with a computer program that is executed by a processor or other computing device in a cooking device. However, the computer program and cooking device illustrated and described herein are merely examples of ways to implement the present invention and may be replaced with other computer programs and equipment without departing from the scope of the present invention.

FIG. 1 illustrates an exemplary cooking device 10 and cooking vessel 12. The preferred cooking device is an induction cooking appliance also called a "cooktop" or "range." The range 10 is adapted to heat the vessel 12 using well-known induction heating whereby an electric heating current is induced in the vessel. The range 10 broadly includes a rectifier 14; a solid state inverter 16; at least one hob having an induction work coil 18; a microprocessor 20; a vessel support mechanism 22; an RFID reader/writer 24; one or more RFID antennas 26; an optional real-time clock 28; an optional memory 30; a microprocessor-based control circuit (not shown); and a user interface 32, including a display 34 or other indicator and an input mechanism 36.

The range 10 accomplishes induction heating in a substantially conventional manner. Briefly, the rectifier 14 first converts alternating current into direct current. The solid state inverter 16 then converts the direct current into ultrasonic current, having a frequency of preferably approximately between 20 kHz and 100 kHz. This ultrasonic frequency current is passed through the work coil 18 to produce a changing magnetic field. The control circuit controls the inverter 16 and may also control various other internal and user-interface functions of the range, and includes appropriate sensors for providing relevant input. The vessel support mechanism 22 is positioned adjacent the work coil 18 so that the vessel 12, resting on the vessel support mechanism 22, is exposed to the changing magnetic field.

The RFID reader/writer 24 facilitates communication and information exchange between the microprocessor 20 and the cooking vessel 12. The RFID reader/writer is connected so as to be in communication with the microprocessor. The preferred RFID reader/writer allows for RS-232, RS485, and TTL communication protocols and can transmit data at up to 26 kb/s. A suitable RFID reader/writer for use in the present invention is available, for example, from Tagsys as the model Medio P031. It should be noted that, because the RFID reader/writer 24 is microprocessor-based, it is within the contemplated scope of the present invention that a single microprocessor could be programmed to serve both the RFID reader/writer and the range's control circuit.

The cooking vessel 12 may be a pot, a pan, a baking dish, a bowl or any other device capable of holding liquids. An RFID tag 38 and a temperature sensor 40 are attached to, embedded in, or otherwise coupled with the cooking vessel. The RFID tag 38 is operable to communicate and exchange data with the microprocessor 20 via the RFID reader/writer 24. More specifically, the RFID tag 38 stores information concerning the vessel's identity, capabilities, and heating history, and can both transmit and receive that information to and from the RFID reader/writer 24. The information includes a number of pan constants or variables that quantify the cooking vessel's boiling characteristics. These constants are downloaded by the RFID reader 24 into the microprocessor at the beginning of each heating cycle to be used as an input to the boiling detection computer program described below. These constants customize the computer program for the specific cooking vessel. A complete list of the pan constants is provided in the attached Appendix A. The RFID tag 38 may also have sufficient memory to store recipe information.

The RFID tag 38 is configured to withstand extreme temperatures, humidity, and pressure. A suitable RFID tag 38 for use in the present invention is the Tagsys model Ario C330. This particular RFID tag has an 8 byte identification code in blocks 0 and 1 of its memory. It also has 2 Kbits of EEPROM memory, where over 1500 bits can be written to by the Tagsys Medio P031 RFID reader/writer.

The temperature sensor 40 is connected to or coupled with the RFID tag 38 and is operable to gather information regarding the temperature of the vessel 12. Any temperature sensor or transducer, such as, for example, a thermistor or resistance temperature device (RTD) can be used with the present invention. The preferred sensor has a near linear voltage output relative to temperature to provide an analog signal which, when converted to a digital signal by the RFID tag, can be transmitted to the RFID reader/writer within normal communication protocols. A suitable, though not necessarily preferred, RFID reader/writer 24 and passive RFID temperature-sensing tag is disclosed in application Ser. No. 10/355,989, hereby incorporated by reference. In order to minimize complexity and cost, the present invention may utilize only one RFID tag 38 to perform temperature sensing and other feedback communications and to process information storage. However, because some RFID tags, such as the Tagsys Ario C330 Tag, are multi-read tags, multiple tag/sensor combinations may be used with this invention.

The temperature sensor 40 is preferably attached to or embedded in the bottom wall of the vessel 12 with the sensor head preferably located at the geometric center of the vessel. It may also be attached using ceramic adhesive to an outside surface of the vessel at a location where the vessel's handle attaches to the vessel's body. Alternatively, the temperature sensor 40 may be attached using any other suitable and appropriate mechanism, such as, for example, mechanical fasteners, brackets, or other adhesives, as long as the attachment mechanism ensures that the temperature sensor 40 will maintain sufficient thermal contact with the vessel throughout its life.

The temperature sensor 40 is preferably attached to the most conductive layer of the vessel 12. For multi-ply vessels, such as those most commonly used for induction cooking, the preferred attachment layer is an aluminum layer. Furthermore, it is preferred to locate the point of attachment no more than one inch above the induction-heated surface of the vessel.

Any wires connecting the temperature sensor 40 to the RFID tag 38 are preferably hidden, such as, for example, in the vessel's handle. If the vessel 12 is such that its handle is more than one inch above the induction-heated surface, the temperature sensor and wires may be hidden within a metal channel so that the RFID tag 38 can remain in the handle. Though not essential, the RFID tag 38 is preferably sealed within the handle so that water does not enter the handle during washing.

Figure 2:
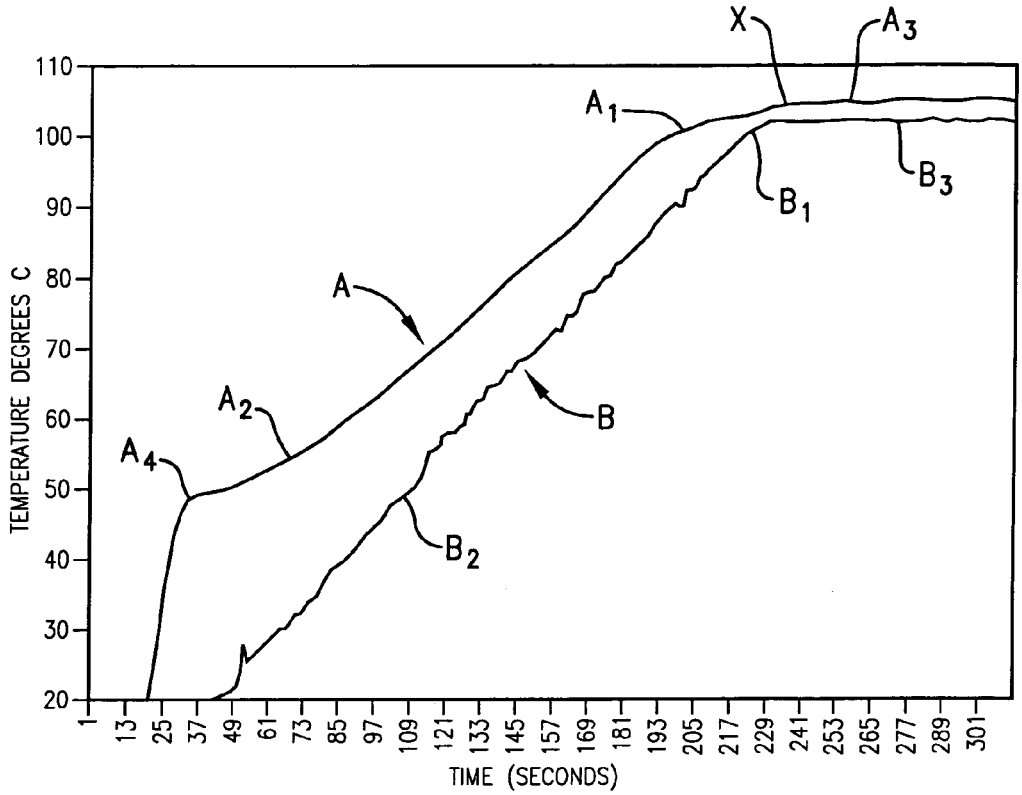
FIG. 2 is a graph showing an exemplary pan temperature versus time curve and an exemplary liquid temperature versus time curve.

FIGS. 2-5 illustrate several temperature characteristics of a pan or other cooking vessel, and the liquid contents of the pan, when heated by the induction range described above. These temperature characteristics are most pronounced when the temperature sensor is located within the walls of the pan at the geometric center of the bottom surface. These temperature characteristics are considered by the computer program when detecting boiling of the liquid as described in more detail below. For example, FIG. 2 shows an exemplary pan temperature versus time (PTT) curve A and an exemplary liquid temperature versus time (LTT) curve B. The PTT curve A shows the temperature of the cooking vessel 12 heated by the induction range 10 plotted over a time period beginning when heat is first applied to the vessel. The LTT curve B shows the temperature of water or other liquid contained in the cooking vessel 12 plotted over the same time period. The LTT curve B shows that the water temperature steadily increases until it reaches its boiling point, at which time the slope of the curve begins to decrease rapidly and eventually achieves and maintains a near zero value. The boiling point occurs near a "water boiling inflection point" $B_1$ which marks when the LTT curve first reaches a near zero slope. Thus, the water boiling inflection point $B_1$ divides the LTT curve B into two portions: a "water climb slope" portion $B_2$ during which the water temperature continues to rise rapidly and the curve exhibits a steep slope; and a "water boiling slope" portion $B_3$ during which the water temperature stops rising appreciably so that the curve exhibits little or no slope.

The PTT curve A exhibits a number of similar characteristics. For example, the PTT curve A has a "near-boiling pan inflection point" $A_1$ which occurs just prior to the water boiling inflection point $B_1$ of the LTT curve B. The near-boiling pan inflection point $A_1$ divides the PTT curve A into two portions: a "pan climb slope" portion $A_2$ during which the pan temperature continues to rise rapidly and the curve exhibits a steep slope; and a "pan boiling slope" portion $A_3$ during which the pan temperature stops rising appreciably so that the curve exhibits little or no slope.

The PTT curve A also exhibits a "pre-boil inflection point" $A_4$ well prior to the near-boiling pan inflection point $A_1$. The pre-boil inflection point $A_4$ corresponds to the pan temperature at the time when full convection of the liquid within the pan begins. At temperatures below the pre-boil inflection point $A_4$, the energy from the range's induction field is being largely absorbed into the pan, thus causing the pan to increase in temperature rapidly. At temperatures above the pre-boil inflection point $A_4$, the liquid within the pan becomes a significant energy sink due to convective activity. Thus, the slope of the PTT curve A prior to the pre-boil inflection point $A_4$ is always greater than the slope of the PTT curve A at temperatures above the pre-boil inflection point $A_4$. The. PTT curve A also exhibits a number of predictable characteristics when certain variables are changed. For example, for higher power levels from the induction range, the PTT curve A has a higher slope prior to the water boiling point. Conversely, for lower power levels from the induction range, the PTT curve A exhibits lower slope values prior to the boiling point. This characteristic illustrates that a liquid in the cooking vessel 12 reaches its boiling point faster when the cooking vessel 12 is heated at a higher power level.

Another characteristic of the PTT curve A is that its slope prior to the near-boiling pan inflection point A, is lower when greater volumes of liquid are in the cooking vessel and higher when less liquids are in the cooking vessel. This characteristic illustrates that greater volumes of liquid take longer to boil than lesser volumes of liquid when both are heated at the same power level. Another characteristic of the PTT curve A is that the pre-boil inflection point $A_4$ is more pronounced with higher volumes of water in the cooking vessel and less pronounced with lower volumes of water in the cooking vessel. In other words, the slope of the PTT curve A doesn't change as dramatically near the pre-boil inflection point $A_4$ for lower volumes of liquid in the cooking vessel 12. This characteristic illustrates that convection heating of liquids within a working vessel occurs more quickly for lower volumes of liquid.

Another characteristic of the PTT curve A is that for a given amount of liquid in the cooking vessel, the temperature at which the pre-boil inflection point $A_4$ occurs increases with higher output power from the induction unit. Another characteristic is that the PTT curve A has a region of nearly constant instantaneous slope between temperatures $A_4$ and $A_1$. Each different type of pan has a particular subset region of temperatures between $A_4$ and $A_1$ for which the average slope between those points is nearly equal to the instantaneous slope at each point on the PTT curve between $A_4$ and $A_1$. The beginning temperature of said unique region is stored as a pan constant called "BoilSlopeStart" on the RFID pan tag of each pan. The ending temperature of said region is similarly stored permanently on the pan tag as the value "BoilSlopeEnd". The average slope between the stored beginning and ending temperature (where such slope is defined as ("BoilSlopeEnd"-"BoilSlopeStart") divided by the elapsed time between those two temperatures) is calculated during each boiling detection process and this value is stored in microprocessor memory, or some memory location accessible to the control microprocessor, as the value called "BoilSlope". The "BoilSlope" is directly correlated to the pan temperature at which boiling occurs. The importance of BoilSlope and its exact correlation to the boiling temperature is discussed in more detail below.

Another characteristic of the PTT curve A is that the ratio or quotient of the PTT curve slope above the pre-boil inflection point $A_4$ (called the "BoilSlope") divided by the curve slope below the pre-boil inflection point $A_4$ (called the "OffsetBoilSlope") is directly correlated to the pan temperature at which boiling occurs. As explained in more detail below, the quotient of these two slopes can be used to determine how many Trigger 3 counts to wait after the near-boiling pan inflection point is detected to signal when boiling has occurred. The higher the value of this ratio or quotient, the longer the count, as described in more detail below.

Another characteristic of the PTT curve A is that if liquid is added to the cooking vessel 12 after an initial boil, the temperature of the cooking vessel 12 when it reaches a second boil will always exceed the temperature of the cooking vessel 12 at the initial boil. For example, if the cooking vessel 12 is initially filled with water and then heated by the induction range, the water will begin to boil at a pan temperature of $T_1$. After the first boil, additional water may be added to the pan and then brought to a second boil. At the time of the second boil, the cooking vessel temperature will be $T_2$. $T_1$ will always be slightly greater than $T_2$. Similarly, if more water is added to the cooking vessel after the second boil, the water will reach a third boil at a pan temperature of $T_3$. $T_3$ will always be slightly greater than $T_2$, which will be slightly greater than $T_1$.

The PTT curve A also exhibits several discernable shapes at or near the boiling point of the liquid which are used by the computer program of the present invention to detect boiling as described below. The computer program then begins a countdown and provides an indication of the boiling after the countdown has elapsed.

Figure 3:
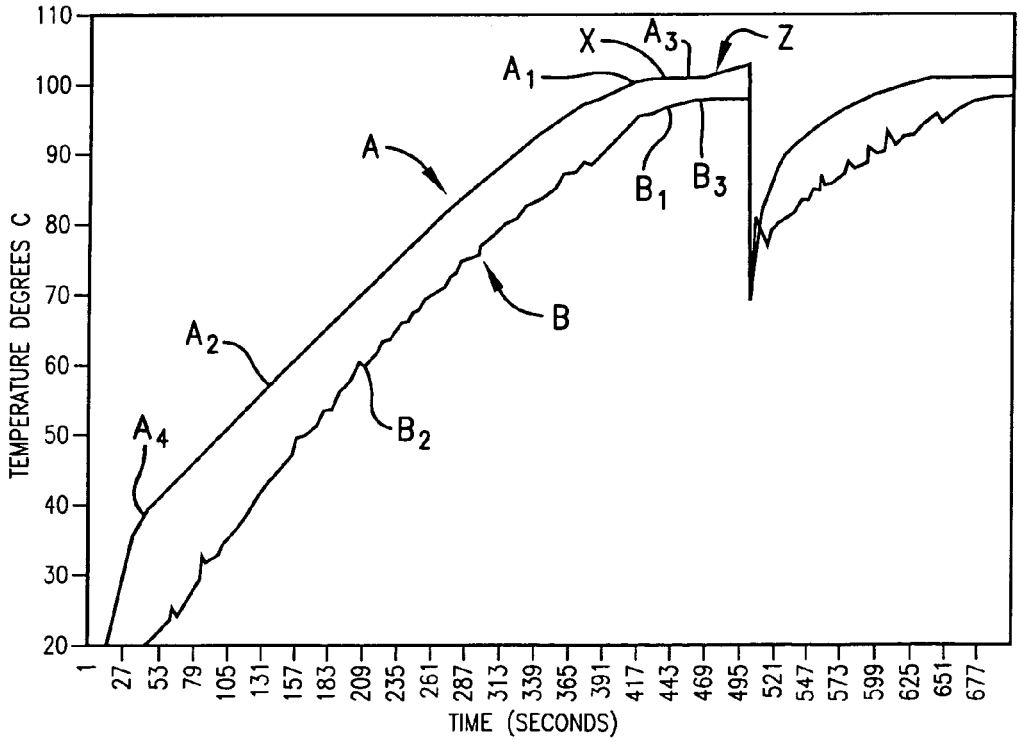
FIG. 3 is a graph showing another exemplary pan temperature versus time curve and another exemplary liquid temperature versus time curve.

The first characteristic shape is the "flat plateau" best illustrated in FIGS. 2 and 3, and identified by the letter X. The flat plateau X begins at the near-boiling pan inflection point $A_1$, which as described above, is the transition from the pan climb slope portion $A_2$ of the PTT curve to the pan boiling slope portion $A_3$. The slope of the pan boiling slope portion $A_3$ of the PTT curve, and thus the flat plateau X, is nearly zero. The flat plateau shape is the most common PTT curve shape and is exhibited for all induction range power levels, and is especially noticeable for low liquid volumes in the cooking vessel.

For flat plateau X curve shapes, there is always a finite elapsed time between the near-boiling pan inflection point $A_1$ and the water boiling inflection point $B_1$. The near-boiling pan inflection point $A_1$ usually occurs first. The larger the value of the pan slope, the smaller the elapsed time between $A_1$ and $B_1$. In some cases of extremely low water level in a pan and extremely high induction range power, $B_1$ may occur before $A_1$. This characteristic is used by the computer program for Trigger 3 as discussed in more detail below.

Figure 4:
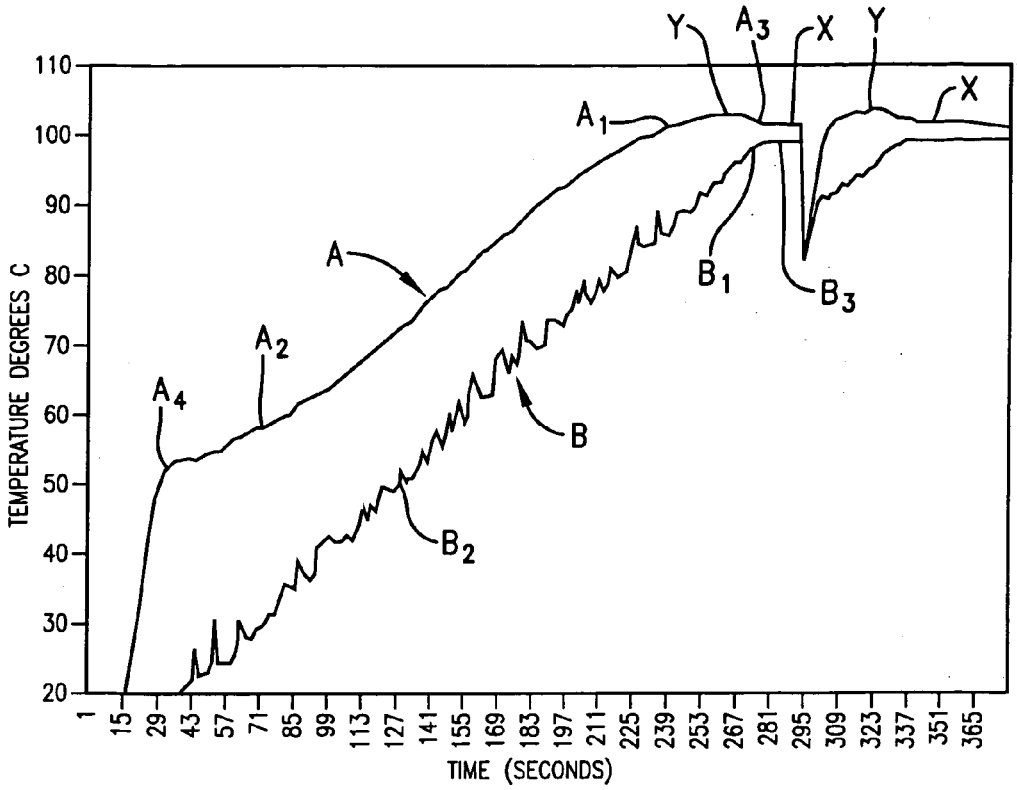
FIG. 4 is a graph showing another exemplary pan temperature versus time curve and another exemplary liquid temperature versus time curve.

A "dip plateau" Y is the next most common PTT curve shape. As illustrated in FIG. 4, identified by the letter Y, the dip plateau shape is identified by a brief increase in the pan temperature which then slopes down to the flat plateau X. The magnitude of the dip is larger for higher induction range power levels and lower liquid volumes and almost imperceptible for low induction range power levels and larger volumes of liquid. As illustrated by the second boil portion of the PTT curve A in FIG. 4, the dip behavior is most common on subsequent boils when very little liquid has been added to an already large volume of boiling liquid. For dip plateau Y curve shapes, the boiling point of the liquid occurs approximately when the dip transitions to the flat 5 portion of the curve.

A "steep rise" is the final common PTT curve feature. As illustrated in FIG. 3, and identified by the letter Z, the "steep rise" Z, should it occur, always follows a region of a "flat plateau" X, and typically occurs just at or just subsequent to the boiling point $B_1$. A steep rise Z is defined to be a region of the PTT curve at least 10 seconds in duration and after a flat plateau area X for which the average slope is greater than 20 percent of the BoilSlope value. The steep rise Z typically occurs for high volumes of water at high induction unit power levels. Also, it has been determined that the steep rise Z occurs more often for soft water.

Figure 5:
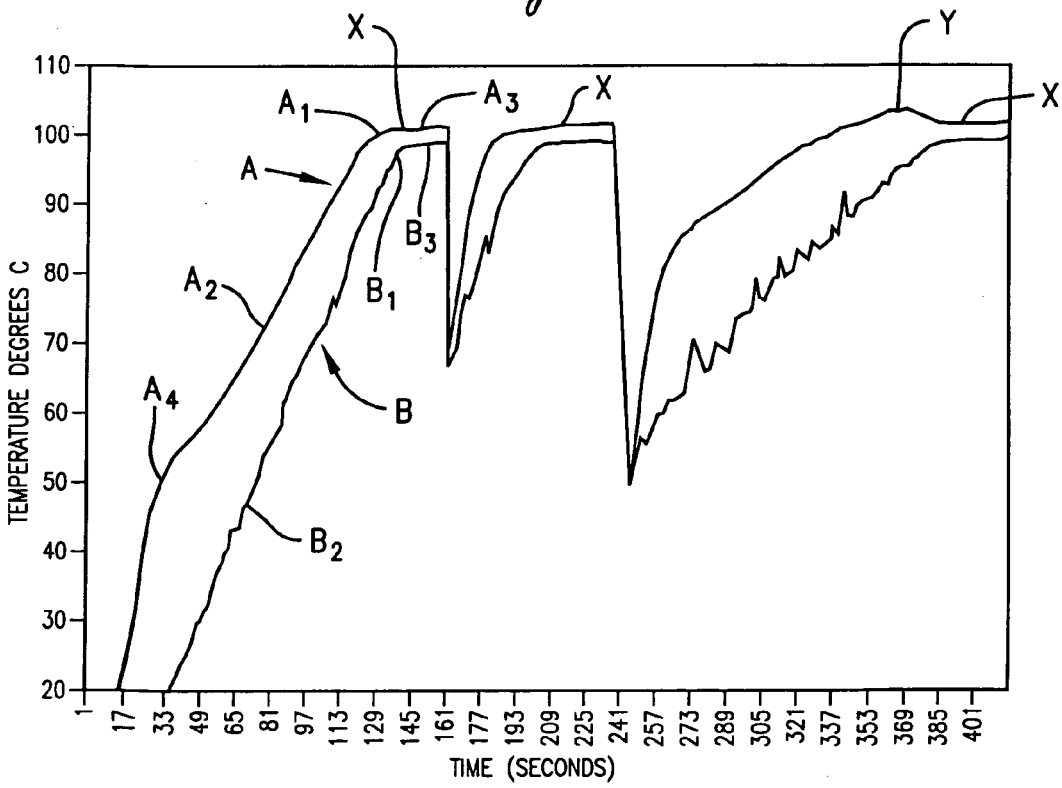
FIG. 5 is a graph showing another exemplary pan temperature versus time curve and another exemplary liquid temperature versus time curve.

As illustrated in FIG. 5, both the flat plateau X and dip plateau Y PTT curve shapes may occur when a liquid is subjected to multiple boils. Most often, the first boil exhibits a flat plateau X shape, sometimes with a slightly increasing slope. Subsequent boils often exhibit the dip plateau shape Y.

The computer program of the present invention detects when a liquid in the cooking vessel 12 begins to boil based on the temperature of the vessel measured over time and at least some of the curve characteristics and shapes described above. The computer program may also take into account other information such as the pan constants or variables discussed above and the power output of the induction range 10 or other cooking device.

Figure 6:
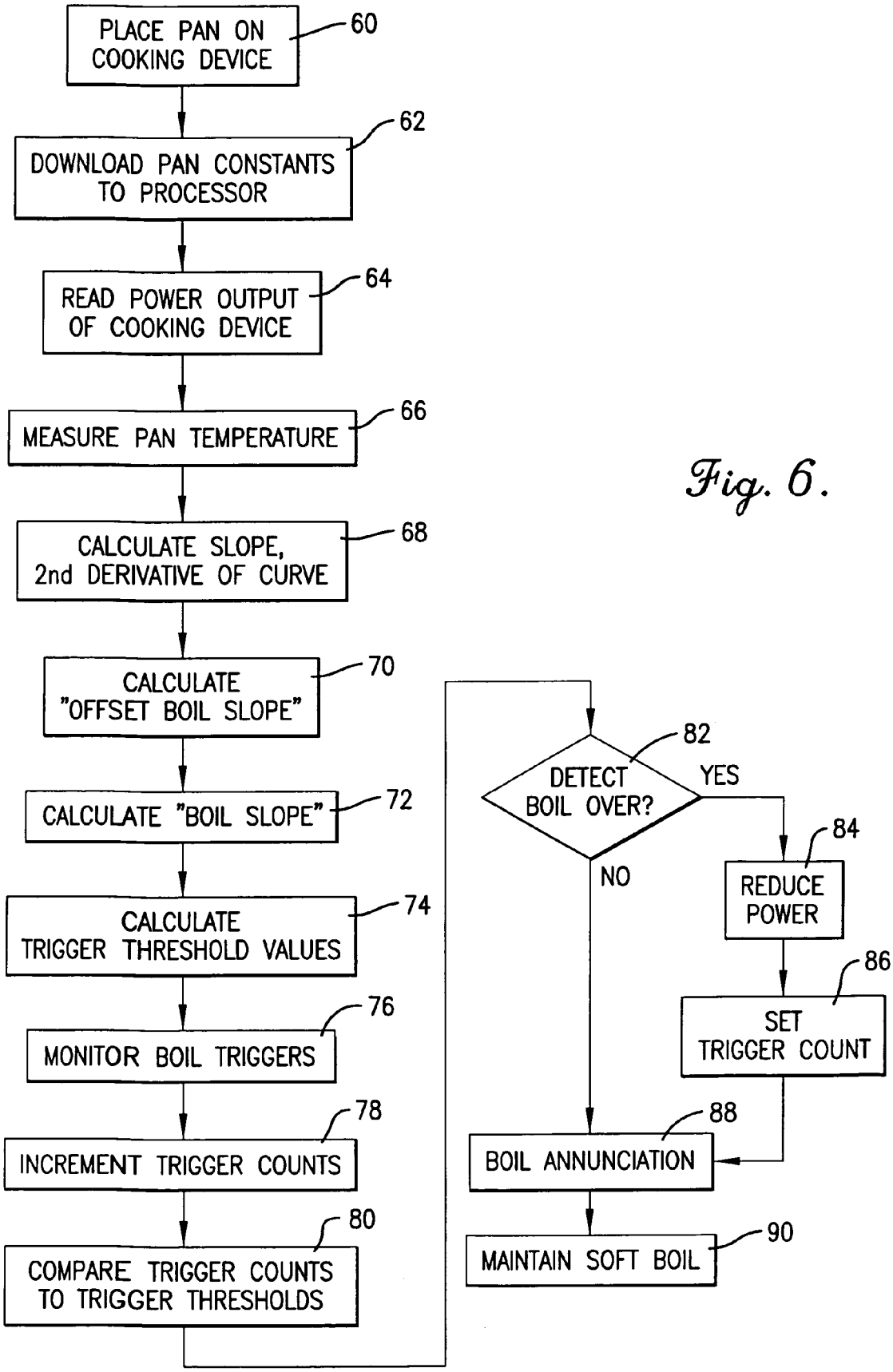
FIG. 6 is a flow diagram broadly depicting the functionality and operation of a preferred implementation of the present invention.

The flow chart of FIG. 6 shows the functionality and operation of a preferred implementation of the present invention. In this regard, some of the blocks of the flow chart may represent a module segment or portion of code of the computer program. In some alternative implementations, the functions noted in the various blocks may occur out of the order depicted in FIG. 6. For example, two blocks shown in succession in FIG. 6 may in fact be executed substantially concurrently, or the blocks may sometimes be executed in the reverse order depending upon the functionality involved.

A pan or other cooking vessel 12 is first filled with water or other liquid or liquid/food mixture and placed on the cooking device 10 as depicted in box 60. The cooking device 10 is then turned on in a conventional manner. Once the cooking vessel 12 is placed on the cooking device 10, the RFID reader 24 on the cooking device 10 reads the pan constants stored in the RFID tag 38 embedded in or attached to the vessel as depicted in box 62. These pan constants are then stored in the memory 30 shown in FIG. 1 or in the processor 20's own memory for later retrieval and use by the processor 20. The pan constants are preferably automatically downloaded in this manner, but they may also be manually entered into memory by way of a keyboard or other input device. An indication of the power output of the cooking device 10 may also be used by the software of this invention, as depicted in box 64. The power output information need not be the actual power output by the cooking device but may instead be the approximate power output for the range that is stored in memory as a function of a power level. For instance, the preferred induction range for this invention has thirty-six discrete power levels, each level corresponding to a known power output in watts. Thus, if the processor 20 is causing the induction range to output power at power level thirty-two, for instance, then the software will use this value thirty-two and possibly a corresponding output power in watts from a lookup table stored within the microprocessor memory.

The temperature sensor 40 within the vessel measures the vessel's temperature the entire time the cooking vessel is on the cooking device, as depicted by box 66. The RFID reader 24 preferably reads the temperature measurements from the RFID tag 38 every second and stores at least some of the measurements, as well as the time they were recorded, in the memory 30 or other memory accessible by the processor 20. The time that a particular temperature was recorded may simply be reflected in its sequence position within the stored memory. For instance, in the preferred embodiment of this software, the last four temperature measurements (from 3 seconds ago, 2 seconds ago, 1 second ago, and the current value) are stored in memory, and thus we know the time when each was stored.

The processor periodically calculates the current slope and second derivative of the PTT curve, as depicted in box 68. The measurements and calculations of boxes 66 and 68 are repeated every second, or some other time interval, so as to create a stored succession of calculated slope and second derivative values.

At a predetermined start and stop temperature prior to the first PTT curve inflection point $A_4$, the microprocessor calculates the value of OffsetBoilSlope, which is the average slope value between that start and stop temperature. For our preferred embodiment at full induction output power, the start temperature is 45 degrees Celsius and the stop temperature is 50 degrees Celsius. The processor 20 calculates the value of OffsetBoilSlope only once per boiling detection process as depicted in box 70.

Later, as the pan bottom temperature exceeds the first PTT curve inflection point $A_4$ and between the temperatures that are stored in the pan tag as the value "BOILSLOPESTART" and "BOILSLOPEEND", the processor 20 calculates the value of BOILSLOPE, which is preferably the average slope between these two temperatures stored on the pan tag. This step in the process is depicted in box 72. As can be seen within the source code of this invention, there are provisions for modifying this region over which the BOILSLOPE is calculated if the software determines that the inflection point $A_4$ occurs within this interval of temperatures that are stored on the pan tag as constants. Typically, if cold water is used to begin a boil operation, the BOILSLOPE will be calculated as an average slope within the interval between pan bottom temperatures BOILSLOPESTART and BOILSLOPEEND. However, if the boil process begins with hot water and/or a hot pan, the software may move this interval over which the BOILSLOPE is calculated so as to make such calculation over a region of nearly constant instantaneous slope values.

Next, the processor 20 calculates the variable portion of several boil detection trigger threshold values that depend upon pan constants stored within the pan tag, the calculated value of BoilSlope, and possibly the value of OffsetBoilSlope. These variable boil detection trigger threshold values, since they depend upon the value of BoilSlope, are reflective of the amount of water in the pan and/or the amount of power applied to the pan by the heating unit. These variable portions of the boil detection trigger thresholds are then added to the fixed portions of the respective boil detection trigger threshold values, also stored in the RFID pan tag, so as to arrive at the total boil trigger threshold values as depicted in Box 74. These total boil detection trigger threshold values are basically time delays after a particular PTT curve A shape, such as a flat plateau X, dip plateau Y, or steep rise Z is detected wherein the water in the pan is boiling. For instance, if the BoilSlope is calculated as a very large value, then the processor will calculate very small variable trigger threshold values and thus small total threshold trigger values. This means, for instance, that, once a flat plateau X is detected, there is a very small delay until the water in the pan is boiling. Alternatively, large total trigger threshold values mean that the flat plateau X, for instance, occurs well before the water in the pan boils.

As is depicted in Box 76, the processor 20 monitors the temperature, slope, 2nd derivative and all such stored values of same each second so as to attempt to detect one of the characteristic curve behaviors of boiling water.

As is depicted in Box 78, once one or more of the characteristic curve behaviors is detected, the processor 20 begins to increment a counter assigned to each boil trigger. Said counters are incremented as long as the criteria assigned to each curve behavior is met and the counters are incremented toward ever greater values, eventually to approach their respective total threshold trigger values.

As is depicted in Box 80, the value of each counter assigned to a specific boil trigger (and indicative of a particular PTT curve behavior) is compared each second to its respective total trigger threshold value. Once a trigger count exceeds its total trigger threshold, the processor 20 determines that boiling has occurred. This determination results in the boil annunciation as shown in Box 88 and reduction of heating unit power to maintain a soft boil as depicted in Box 90.

The processor 20 also detects for boilovers as depicted in box 82. To do so, the processor 20 first must have recorded a very small value of BOILSLOP, which represents a large amount of water in the pan. Then, the processor 20 evaluates the calculated PTT curve slopes and looks for a region of slopes essentially equal to zero followed immediately by a very large slope value. Applicant has discovered that such a behavior 30 indicates a rapid boil which, if left unchecked, results in liquid boilover. If a boilover is detected in box 82, the processor 20 sends a signal to the cooking device 10 to reduce the cooking power as depicted in box 84. The processor 20 then sets one of the trigger counts to a level that immediately triggers the boil annunciator as depicted in boxes 86 and 88. The processor 20 then sends a signal to the cooking device 10 that adjusts the power level of the cooking device to maintain a soft boil as depicted in box 90.

A computer program which may be used to implement the functionality and operation of the invention described herein is reproduced on the enclosed compact disc. The computer program is merely an example, and may be replaced with other computer programs without departing from the scope of the present invention. The computer program (also referred to as an "algorithm" herein) is stored in or on computer-readable medium residing on or accessible by the processor 20 of the range 10. For example the computer program may be stored on the memory 30. The computer program preferably comprises an ordered listing of executable instructions for implementing logical functions in the processor.

The computer program can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disc read-only memory (CDROM). The computer-readable medium could even be paper or another suitable medium upon which the program is printed, as the program can be electronically captured, via for instance, optical scanning of the paper or other medium, then compiled, interpreted, or otherwise processed in a suitable manner, if necessary, and then stored in a computer memory.

There are eleven primary functions in each of the boil detection computer program set forth on the compact disc: RecordNewTemperature; Compute Boil Slope; Boil Monitor; Compute Trigger2AddCounts; Boil Detection Triggers 1-5; ResetBoilVariables; and InitializeBoilMX. Each of these functions is described below.

The RecordNewTemperature function is designed to store all of the raw information and many of the calculated values used by the other functions. For instance, the RecordNewTemperature function stores and/or calculates the last seven pan temperature values, the last four heating device power levels (power in watts is then determined in a look-up table), the last seven slope values, and the last four second derivatives. The Compute Boil Slope function does just that—it computes the BoilSlope value and stores it for later use in calculating the variable portions of the trigger thresholds. The Boil Monitor function monitors critical factors used to detect boiling, performs the boil annunciation, calculates the Offset Boil Slope, checks for boilover, compares trigger counts to trigger thresholds, and calls the five boil detection triggers. The Compute Trigger2AddCounts function calculates the final trigger threshold value for boil trigger 2. The Boil Trigger 1 Function mainly looks for additions of food to the pan prior to the boil detection point. Each of the other four boil detection triggers decide when a particular PTT curve feature is present, calculate the particular final trigger threshold values, and decide when to increment that particular trigger counter. The Boil Trigger 2 Function is designed to detect the dip plateau Y curve behavior and then begin a counter when it has been detected. Boil Trigger 2 does not use the value of BoilSlope in any of its calculations. The Boil Trigger 4 function is designed to determine the flat plateau X without the use of the value of BoilSlope. In both cases, the successfully-measured value of the BoilSlope (the value of the PTT curve after the "pre-boil" inflection point) is not critical to their success in detecting the boiling point of the water.

Two of the triggers, Trigger 3 and Trigger 5, are designed to detect the flat plateau X curve behavior and then begin a counter when it has been detected. The Trigger 3 function is designed to use the flat plateau information for the most precise detection of the boiling point, whereas the Trigger 5 function is designed to be a "fail-safe" detection method. In both cases, the successfully-measured value of the BoilSlope (the value of the pan temperature vs. time curve after the pre-boil inflection point) is critical to the success of their accuracy.

In all cases for Triggers 3 through Trigger 5, a Pan Tag value is used as a fixed portion of a counter threshold, which, when added to a variable portion, becomes the total trigger threshold counter beyond which a boil indication is annunciated by the processor 20. Also, in each case, a variable portion of a counter threshold, called a "TriggerXAddCount" (where "X" is either 3, 4, or 5) is also used. This variable threshold value typically depends upon the value of BoilSlope and sometimes, a value called OffsetBoilSlope.

The following paragraphs describe the eleven functions of the computer program in more detail.

Record New Temperature Function

The RecordNewTemperature function stores all of the raw information and many of the calculated values used by the other functions. For instance, the RecordNewTemperature function stores and/or calculates the last seven pan temperature values, the last four heating device power levels (power in watts is then determined in a look-up table), the last seven slope values, and the last four second derivatives.

Compute Boil Slope Function

The purpose of the Compute Boil Slope Function is to compute the BoilSlope value and stores it for later use in calculating the variable portions of the trigger thresholds. Since most recipes call for cold water to be brought to boil with our without ingredients, the default initial condition is for the water to begin in a near-room temperature state. When this is the case, the BoilSlope is simply calculated as the difference in pan tag temperature over a fixed interval divided by the elapsed time for the pan to traverse said temperature interval. The Pan Tag constants called BoilSlopeStart and BoilSlopeEnd are the limits of to that fixed temperature interval. Thus, once the Pan Tag temperature is determined to have first risen above BoilSlopeStart and the Function determines that the slope of the PTT curve is a steady, positive one, that exact value of Pan Tag temperature is memorized and a timing counter is begun. Once the Pan Tag temperature is determined to first exceed the value BoilSlopeEnd, the Function memorizes that temperature and stops the timing counter. The BoilSlope is the difference in temperature divided by the magnitude of the timing counter.

Of course, the liquid may not always start in a cool state during a boiling recipe step where the boiling point must be detected. Thus, there are provisions made in this Function to attempt to determine the BoilSlope over a suitably stable range of temperatures somewhere between the Pan Tag Value of BoilSlopeStart and the inflection point $A_1$ on the PTT curve. For instance, if the PTT curve's slope is not steady as the pan tag temperature crosses the value of BoilSlopeStart, the timing counter will not start counting but will wait for such a steady region of slope. Furthermore, if, by the time the timing counter finally begins counting the value of BoilSlopeStop is exceeded too quickly (so that not much of an elapsed time occurs over which to calculate a BoilSlope value), the timing counter will be allowed to continue until the Pan Tag temperature crosses another Pan Tag constant called the BoilTriggerTemp. This extension allows enough of an interval of temperatures to elapse so as to get a more accurate measure of the average slope value between the inflection points $A_4$ and $A_1$—the true objective of calculating the BoilSlope.

Of course, the customer may add food ingredients (including more liquid), after a first boil has been achieved and detected. Thus, the function Compute Boil Slope has provisions for calculating the value BoilSlope for use in subsequent boil detection after said food addition. In this case, the Function has provision for not starting the timing interval until it has determined that a steady region of PTT slope exists. Furthermore, the timing stops (and calculation is done) no later than the temperature at which boiling has been just previously been detected and no later than the second inflection point $A_1$ (for the subsequent boil PTT curve).

Boil Monitor Function

The Boil Monitor function monitors critical factors used to detect boiling, calculates the Offset Boil Slope, checks for boilover, compares trigger counts to trigger thresholds, calls the five boil detection triggers, and performs the boil annunciation. The Boil Monitor Function also calculates the "Offset Boil Slope", which is the slope of the Pan Temperature vs. Time curve before the pre-boil inflection point. This value will be used in Trigger 2 to calculate a value of Trigger 2 Add Counts. This value of OffsetBoilSlope is also used within the Boil Trigger 3 function to calculate the variable Trigger 3 Count Threshold for cases where the pan is not centered over the heating element of the range. It has been found that in such cases of an offset pan, the value of OffsetBoilSlope is significantly larger than its value when the pan is centered over the range. Thus, the ratio of OffsetBoilSlope/BoilSlope gives an indication as to when a pan is off-centered. The Trigger 3 variable portion of the threshold counts is calculated by a product of a Pan Tag constant called OffsetBoilMultipler times the ratio of OffsetBoilSlope to BoilSlope for those cases of an offset pan.

The Boil Monitor Function calls all 5 Boil Trigger Functions. These Boil Trigger Functions all are used to detect the boiling point and are described in more detail below. Trigger 1 is used within the other 4 Triggers but itself cannot cause the boiling detection system to say that the liquid has boiled. For each Trigger 2 through Trigger 5 conditional statement, the counts counted within the Trigger function itself must exceed the sum of: 1) a pan tag value that is the fixed value for boiling to occur, and 2) a variable value called "TriggerXAddCounts" that varies depending upon the amount of liquid in the pan and the power applied (both of which are reflected by the BoilSlope calculated above the pre-boil inflection point and may be reflected in the ratio of OffsetBoilSlope to BoilSlope).

The Boil Monitor Function also continuously compares the trigger counts from Triggers 2, 3, 4, and 5 to the total trigger threshold counts for each respective trigger. Once any one of the Boil Trigger's incremental counts exceeds the respective total threshold value, the Boil Monitor function causes the boil to be annunciated and the power to be reduced so as to achieve a soft boil. After detecting a boil, the Boil Monitor Function triggers an annunciator or indicator. The alert or indicator may be visual, audible or vibratory in nature, but is preferably a visual indicator such as a blinking red light or text message.

The Boil Monitor Function also monitors the Pan Temperature to detect a or food addition to the pan. The first condition is looking for a very small drop in temperature (3 degrees C. or more) that corresponds to a very small addition of food or liquid to the pan. In this case, the value of Boil Slope is not recalculated.

The second condition is looking for a very large drop in temperature or a very large negative slope, which is indicative of a large addition of liquid or food. In this case, the value of Boil Slope is recalculated. In these subsequent boil situations, if a new boil slope calculation has been required because we have detected a "big drop" within the Boil Monitor Function, then we will wait to calculate the new value of boil slope until just after the boil slope has stabilized. This stabilization occurs after the turbulence of adding food or water to the pan has ceased. This occurs when the slope of the pan temperature vs. time curve stabilizes at a value smaller than the previously calculated BoilSlope (which is stored as the value LastBoilSlope). If the slope of the pan temperature vs. time curve never stabilizes prior to reaching a value of temperature equal to the LastBoilTemperature minus 3 C, then the stored value of LastBoilSlope is used for Trigger functions.

The Boil Monitor Function also looks for signs of a boil so vigorous that liquid is spilling out over a pan without a lid or is causing a pan with a lid to spew liquid out. This condition typically only occurs when the liquid level in some pans exceeds 90% capacity of the pan. The Pan Tag value called PanTag. STOPBOILOVERFLOWSLOPEf is a minimum value of Boil Slope that, if calculated, tells the system to watch for this condition. A 4-quart pan, for instance, has this problem but a 2-quart pan has less of a problem. Thus, the Pan Tag value can be set to zero to defeat this function. Should the system detect the liquid spilling out of the pan, it reduces the power and sets the Trigger 4 counts above the total Trigger 4 counter threshold so as to cause the system to detect a boiling condition and turn on the boiling annunciator.

Compute Trigger2AddCount Function

The Compute Trigger2AddCount Function simply computes the total trigger threshold for the Boil Trigger 2. In this case, Trigger 2 does not have a Pan Tag value corresponding to a fixed trigger threshold value, so this calculation is of the variable portion and equals a constant times the ratio of OffsetBoilSlope to BoilSlope. This constant is the value 2 for initial boils and the value 4 for subsequent boils (after an addition of food to a boiling pan of water or other liquid).

Boil Trigger 1 Function

Boil Trigger 1 can never cause a boil annunciation because some Trigger 1 counter exceeds a trigger 1 threshold. Said Trigger 1 counter and Threshold values do not exist. The main purpose of the Boil Trigger 1 function is to determine when the PTT curve reaches the Boil Inflection Point $A_1$. It requires two values of the Pan Temperature slope in a row to be less than a percentage of the calculated Boil Slope in order to detect this inflection point. This percentage may vary from pan to pan and is thus a Pan Tag variable called PanTag.BOILTRIGGER1PCTf. Once the inflection point is found, a critical flag for Trigger 5 (a less sensitive detector of the flat plateau curve feature). This flag, when set to true, allows Trigger 5 to begin counting so as to detect a boil.

Another function of Boil Trigger 1 is to determine when liquid or food has been added prior to the first indication of boiling. In this case, the boiling variable are reset (to include all Boil Trigger incremental count values), and a new heating cycle is begun to again attempt to reach a boiling temperature.

Boil Trigger 2 Function

The Boil Trigger 2 function is the most sensitive and accurate method of detecting the "Dip" Plateau curve shape and then detecting the boiling point of water that occurs near the base of the dip portion of the "Dip" Plateau where the flat portion of the plateau begins. This function first must differentiate a true "Dip" Plateau behavior from noise. Thus, it requires both a descent in pan temperature that is the proper shape: Long enough in duration and deep enough in temperature drop. Three Pan Tag variables are used to ensure that each pan's unique length and depth of "Dip" Plateau's is characterized. These values are called: PanTag.BOILTRIGGER2DIPVALUEf (a threshold minimum of the depth of the dip required to even begin considering the phenomenon as a dip and not just noise), PanTag.BOILTRIGGER2RISESf (a threshold minimum of the depth and duration of the DIP), and PanTag.BUMPSIZEMINIMUMf (a threshold minimum of the LENGTH of the DIP).

The measured parameter used to determine the depth of temperature drop is the average of the previous seven temperatures minus the most recently measured Pan temperature. The computer program refers to this number as the "quantity" expressed by the quotation (AverageLast7Temperatures-BoilData.LastMeasuredTemperatures[0]). Once a true "Dip" Plateau is differentiated from noisy temperature readings, then the location of the boiling point of water along the "Dip" structure is calculated by looking for the flat portion of the plateau after the descent. At this point, a Trigger2DelayCounter is started and runs until its value is higher than the Trigger 2 threshold that is set within the Boil Monitor function. When a true DIP has been found, a flag called "Trigger2DipSuccess" is set to true. The Boil Trigger 2 function now looks for the flat portion of the plateau after the descent portion. Once this point on the dip is found a flag, called Trigger2TotalSuccess is set to true.

At this point, a true dip and the flat portion of the plateau after the descent portion have been detected. Thus, a counter called the Trigger2DelayCounter is started. Once this value exceeds the required counts threshold set in the Boil Monitor function, Trigger 2 has detected the boiling point. The Boil Trigger 2 function also differentiates a true dip from noisy temperature readings. It does so by looking for the proper magnitude of the value of (AverageLast7Temperatures-BoilData.LastMeasuredTemperatures[0]), the number of times that this value exceeds the proper threshold, and the shape of the dip.

Boil Trigger 3 Function

The Boil Trigger 3 function is the most sensitive detector of the "Flat" Plateau curve feature and the most accurate predictor of the boil temperature for this phenomenon. This function also detects the "Steep Rise Z" curve features.

The three main purposes of the Boil Trigger 3 function are to calculate the total Trigger 3 Threshold Counts (by adding the fixed Pan Tag value to a variable value it calculates that is based upon the BoilSlope and/or the OffsetBoilSlope), to determine when to increment the Trigger 3 counter, and to determine when a Steep Rise Occurs.

For the first purpose, there are two methods to calculate the variable portion of the Trigger 3 Threshold Counts which is called "Trigger3AddCounts". The outcome of each method is compared and the largest value is used as the variable component of the Trigger 3 threshold value. The first method involves dividing a Pan Tag value called PanTag.BOILTRIG3ADDCTNUMBER by the calculated value of BoilSlope. The second method involves multiplying a Pan Tag value called PanTag.OFFSETBOILMULTIPLIER by the ratio of OffsetBoilSlope and BoilSlope. If the latter value is larger, the algorithm knows that the pan has been placed in an offset position over the heating element.

For the second purpose, this function essentially looks for the Pan Temperature Near-Boil Inflection Point and then begins to count and maintains the count as long as the PTT curve slope stays below certain thresholds. Two measured parameters are used (due to noise) to determine whether and when the Flat Plateau exists: 1) the "quantity" of the average of the previous seven temperatures minus the most recently measured Pan temperature (this is the same quantity used in the Boil Trigger 2 function) and, 2) the PTT curve "Slope", where "Slope" is the average of the last four values (to include the current Measured Pan Temperature) of Measured Pan Temperature minus the average of the previous four Measured Pan Temperatures (to exclude the current Measured Pan Temperature but include the previous four temperatures before it).

This function also sets the minimum pan temperature that is allowed for the counter BoilData.Trigger3Count to be incremented. For initial boils, this minimum temperature at which the Trigger 3 Function Becomes active is a Pan Tag Value called PanTag..BOILTRIGTEMPf. For subsequent boils, the minimum temperature is the last detected boiling temperature (the pan measured temperature of the internal sensor) minus 2 C, where the last detected boiling temperature is stored in memory as LastBoilTemp.

The Boil Trigger 3 function also compares the two measured parameters discussed above to threshold values to ensure that the pan is experiencing the "FLAT" Plateau and thus to begin incrementing the Trigger 3 counter called "BoilData.Trigger3Count". The threshold value for Slope is a the same percentage of the Boil Slope that is used in Trigger 1 to determine the inflection point—that percentage being a Pan Tag value called PanTag.BOLTRIGGER1PCTf. The threshold value for the quantity (AverageLast7Temperatures-BoilData.LastMeasuredTemperatures[0]) is also a percentage of the measured Boil Slope that is a Pan Tag Value called PanTag.BOILTRIGGER3DELTAf.

The Trigger 3 Function also looks to detect a region of Steep Rise Z. It does so by looking to see when the Trigger 3 counter value has stalled at a high percentage of its total Trigger 3 threshold value. If so, it means that the flat plateau has existed and then a steady steep climb is occurring (because the Trigger 3 counts cannot increment any longer due to having a slope value greater than the threshold values set forth in the Pan Tag). When a Steep Rise is detected, a boil annunciation is initiated after a short interval that is based upon the Pan Tag value called PanTag.TRIG5NOISECOUNTER.

Boil Trigger 4 Function

The Boil Trigger 4 function has three main functions. The first is to calculate the variable and total Trigger 4 Threshold values. The second is to determine the very beginning of the "Flat Plateau" region of the PTT curver. The third is to increment the Trigger 4 counter as long as the "Flat Plateau" continues to exist and to do said incrementing without relying on the value of BoilSlope in any way.

The Boil Trigger 4 total Threshold value is the sum of a constant value plus a variable value that depends upon the BoilSlope. The constant value is a Pan Tag value called PanTag.TRIGGER4VALUE. The variable value is found by dividing the Pan Tag value called PanTag.TRIGGER4ADDCOUNTS by the calculated value of BoilSlope.

The second purpose of this function is to determine a minimum pan temperature requirement for the Trigger 4 counts to be incremented. The Pan temperature equal to the Pan Tag Value called PanTag.BOILTEMPf must first be exceeded. Next, the Pan Temperature "Near-Boiling" Inflection Point must be determined—which is done within BOIL TRIGGER 1 when the flag called "BeginTrigger5Look" is set to True. When those conditions are met, a flag called "ArrivedAtPeak" is set to true. After the flag "ArrivedAtPeak" has been set, the algorithm begins to count when the Flat Plateau portion of the PTT Curve exists.

The function also sets the minimum pan temperature requirement for Trigger 4 detection to begin for Subsequent Boils. The pan temperature must exceed the LastBoilTemp minus 2 C.

Once said beginning of the "Flat Plateau" has been determined, the Boil Trigger 4 counter may be incremented under certain conditions set forth in this function. Each time the current average of the last seven temperatures is lower than the past average, the algorithm begins a counter called BoilData.Trigger4Count. This counter value is reset each time a new peak temperature is reached. The average of the last seven temperatures quantity used within Trigger 4 is the value called "AverageLast7Temperatures", which is simply the average value of the last seven Pan measured temperatures.

Boil Trigger 5 Function

The Boil Trigger 5 function is the least sensitive and Least Accurate method of determining the boiling point of water that is characterized by the "FLAT" Plateau curve behavior. This Trigger 5 is essentially a "last chance" trigger that should only cause the boil to be detected if all other triggers fail to act. This Trigger has a counter called the "Trigger5Count" that is incremented each time that the PTT curve Slope value is less than the threshold level that corresponds to the same condition used in Boil Trigger 1 Function to determine the Pan Temperature "Near-Boiling" Inflection Point. As long as the PTT curve maintains the "flat" Plateau behavior, this counter increments. Thus, the measured parameter used within Trigger 5 is the PTT curve Slope. However, due to noisy temperature readings, there is a noise detection system built into Trigger 5 that will reset the Trigger5Count value if the PTT curve Slope exceeds the Inflection point slope threshold for more than a fixed number of seconds in a row. This fixed number of seconds is a Pan Tag value called the PanTag.TRIG5NOISECOUNTERf.

The function compares the PTT curve to a percentage of the measured Boil Slope, where that percentage is a Pan Tag value called "PanTag.BOILTRIGGER1PCTf". If the Slope value is less than this percentage of the BoilSlope, then the counter called Trigger5Count is incremented. Trigger5Count is decremented if the Slope exceeds the threshold value for more than a given number of seconds in a row. That given number of seconds is a Pan Tag value called PanTag.TRIG5NOISECOUNTERf.

Reset Boil Variables Function

The Reset Boil Variables Funtion exists simply to initialize variables, flags, and counters used within the Boiling Detection Algorithm each time the function is called (at the beginning of First Boils and when a big drop has been detected).

Initialize Boil MX Function

The purpose of this function is to reduce the heating unit power output to the proper value so as to maintain a proper boil level, particularly a soft boil.

The present invention provides numerous advantages not realized with the prior art. For example, the computer program, method and cooking device of the present invention quickly and accurately detect boiling of a liquid in a cooking vessel. The present invention also allows a soft boil to be maintained and prevents boilovers. The invention achieves the foregoing for any cooking vessel, any amount or type of liquid in the vessel, and any amount of cooking energy delivered by the cooking device. One important aspect of the invention is the detection of boiling based on the slope of a pan versus temperature (PTT) curve A. By detecting boiling with slope values, rather than absolute temperature values, the invention is accurate regardless of the particular boiling temperatures of liquids and the heating characteristics of different cooking vessels.

Although the invention has been described with reference to the preferred embodiment illustrated in the attached drawing figures, it is noted that equivalents may be employed and substitutions made herein without departing from the scope of the invention as recited in the claims. For example, although the computer program of the present invention is preferably used with an induction range, it may also be adopted for use with other cooking devices.

Having thus described the preferred embodiment of the invention, what is claimed as new and desired to be protected by Letters Patent includes the following:

APPENDIX A

PAN TAG CONSTANTS

1. PanTag.BOILTRIGTEMP—The pan temperature below which all of the Trigger Functions do not allow Trigger Counts to be incremented.
2. PanTag.BOILSET—The system control temperature when a Recipe Step of "BOIL" is used.
3. PanTag.BOILSLOPESTART—The minimum pan temperature at which the system can begin to calculate the value BOILSLOPE on initial boils.
4. PanTag.BOILSLOPEEND—The minimum pan temperature at which the system can finish the calculation of the value BOILSLOPE on initial boils.
5. PanTag.MAXBOILWATTS—The maximum wattage that is allowed when a Recipe Step of "BOIL" is used.
6. PanTag.BOILTRIGGER1PCT—A percentage of the value of BOILSLOPE, below which we take actions within Trigger 1 and Trigger 3.
7. PanTag.MAXLS—The maximum slope value during boiling of water that is not considered noise for a given pan.
8. PanTag.BOILTRIGGER2DIPVALUE—A measure of the slope value above which, and after certain other conditions exist, we consider that the PTT curve has begun to experience a "Dip Plateau".
9. PanTag.BOILTRIGGER2RISES—A measure of the number of seconds the PTT Curve slope must exceed the value of PanTag.BOILTRIGGER2DIPVALUE, and have met certain other conditions, in order to consider that the PTT Curve has experienced a "Dip Plateau".
10. PanTag.BUMPSIZEMINIMUM—A measure of the minimum total depth of a "Dip Plateau" that differentiates a true "Dip Plateau" from noise.
11. PanTag.MINDELTA[4]—A value used within the comparison between Trigger 2 Counts and the total Trigger 2 Threshold value.
12. PanTag.BOILTRIGGER3DELTA—A percentage of the BOILSLOPE below which we consider incrementing the value of Trigger 3 Counts.

13. PanTag.BOLTRIGGER3VALUE—The fixed portion of the total Trigger 3 Threshold Value.
14. PanTag.BOILTRIG3ADDCTNUMBER—A constant used in the calculation of the variable portion of the total Trigger 3 Threshold Value.
15. PanTag.T3RISEPCT—A measure of the minimum number of seconds of steep slope (after a segment of a "Flat Plateau") that is required to consider a segment of the PTT Curve to have achieved a "Steep Rise" feature.
16. PanTag.MINDELTA[3]—A minimum number of the calculated Trigger 3 variable Threshold, below which we automatically make the variable Trigger 3 Threshold Value equal to zero.
17. PanTag.TRIG3MEDDROPMULTI—A multiplier value of the total Trigger 3 Threshold value for secondary boils where a medium amount of food has been added to an already boiling amount of liquid.
18. PanTag.TRIG3LGDROPMULTI—A multiplier value of the total Trigger 3 Threshold value for secondary boils where a large amount of food has been added to an already boiling amount of liquid.
19. PanTag.OFFSETBOILMULTIPLIER—A constant used within the calculation of the variable portion of the total Trigger 3 Threshold value that allows the algorithm to determine if the pan is off-center on the heating element.
20. PanTag.BOILTRIGGER4VALUE—The fixed portion of the total Trigger 4 Threshold value.
21. PanTag.TRIGGER4ADDCOUNTS—A constant used to calculate the variable portion of the total Trigger 4 Threshold value.
22. PanTag.MINDELTA[6]—A multiplier of the total Trigger 4 and Trigger 5 Threshold values that is used when the pan has been detected to be offset on the heating element.
23. PanTag.BOILTRIGGER5VALUE—The fixed portion of the total Trigger 5 Threshold Value.
24. PanTag.TRIGGER5ADDCOUNTS—A constant used to calculate the variable portion of the total Trigger 5 Threshold value.
25. PanTag.TRIG5NOISECOUNTER—A number of seconds of noise that is used within various Trigger functions to determine when to reset counters and to take other actions.
26. PanTag.STOPBOILOVERFLOWSLOPE—The minimum value of BOILSLOPE that must exist before the algorithm considers to exercise the actions to prevent Boil Over due to excess water in the pan.
27. PanTag.LIDOFFSOFTWATTS—The value of output power used to maintain a soft boil with the pan lid off.
28. PanTag.LIDOFFHARDDELTA—The value of output power, when added to PanTag.LIDOFFSOFTWATTS, that will maintain a rapid boil for a pan with approximately 60% full volume of liquid and the lid off.
29. PanTag.LIDOFFLEVELCORRECTION—A value that is used to reduce the total wattage used, when the lid is off, to maintain a rapid boil for a small amount of water in the pan.
30. PanTag.LIDONSOFTWATTS—The value of output power used to maintain a soft boil with the pan lid on.
31. PanTag.LIDONHARDDELTA—The value of output power, when added to PanTag.LIDONSOFTWATTS, that will maintain a rapid boil for a pan with approximately 60% full volume of liquid and the lid on.
32. PanTag.LIDONLEVELCORRECTION—A value that is used to reduce the total wattage used, when the lid is on, to maintain a rapid boil for a small amount of water in the pan.

The invention claimed is:

1. A device for heating liquid within a vessel, the device comprising:

a heating element for heating the vessel, said vessel including memory storing one or more variables relating to the boiling characteristics of the vessel, and a temperature sensor operable to collect data representative of successive temperatures of the vessel over time;

a data input for receiving from said vessel memory said one or more variables relating to said boiling characteristics of the vessel, and for receiving said data representative of successive temperatures of the vessel over time; and a computing device operably coupled with said data input to detect boiling of the liquid using said one or more variables relating to the boiling characteristics of the vessel and the data representative of the successive temperatures of the vessel over time, and to provide an output, said computing device having a boil detection program, said one or more variables relating to said boiling characteristics of the vessel received by said data input being used to customize said boil detection program for said vessel.

2. The device as set forth in claim 1, wherein the heating element is an induction work coil of an induction range.

3. The device as set forth in claim 1, wherein the data input comprises an RFID reader/writer which reads said variables relating to the vessel and the data representative of the successive temperatures of the vessel over time from an RFID tag coupled with the vessel.

4. A method of detecting boiling of a liquid in a vessel heated by a heating unit, said heating unit including a data input and a computing device having a boil detection program, the method comprising the steps:

placing the vessel on a heating element of the heating unit, said vessel including memory storing one or more variables relating to the boilina characteristics of the vessel, and a temperature sensor operable to collect data representative of successive temperatures of the vessel over time;

causing said data input to receive said one or more variables relating to said boiling characteristics of said vessel, and using said one or more variables relating to said boiling characteristics of the vessel to customize said boil detection program;

using said temperature sensor to measure successive temperatures of the vessel over time, and causing said data input to receive said successive measured temperatures of the vessel;

detecting boiling of the liquid in the vessel using said customized boil detection program and the successive temperatures of the vessel over time; and providing an indication that the liquid is boiling.

5. The method as set forth in claim 4, wherein the heating unit is an induction range and the heating element is an induction work coil.

6. The method as set forth in claim 4, wherein the vessel temperature measuring step is performed with a resistant temperature device embedded in the cooking vessel.

7. The method as set forth in claim 4, wherein the boiling indication is presented on an indicator selected from the group consisting of a visual indicator, an audible indicator, and a vibratory indicator.

8. The method as set forth in claim 4, including the step of storing said variables relating to said vessel in memory carried by said vessel.

9. The method as set forth in claim 8, said memory operably coupled with a RFID tag secured to said vessel, said data input comprising a RFID reader operably coupled with said heating unit.

* * * * *